US009334699B2

(12) United States Patent
Bender et al.

(10) Patent No.: US 9,334,699 B2
(45) Date of Patent: May 10, 2016

(54) DRILL CUTTINGS CONVEYANCE SYSTEMS

(71) Applicant: Beitzel Corporation, Grantsville, MD (US)

(72) Inventors: Shawn Bender, Accident, MD (US); Donald C. Brenneman, Grantsville, MD (US)

(73) Assignee: Beitzel Corporation, Grantsville, MD (US)

( * ) Notice: Subject to any disclaimer, the term of this patent is extended or adjusted under 35 U.S.C. 154(b) by 0 days.

(21) Appl. No.: 14/602,736

(22) Filed: Jan. 22, 2015

(65) Prior Publication Data

US 2015/0129312 A1 May 14, 2015

Related U.S. Application Data

(63) Continuation-in-part of application No. 13/804,272, filed on Mar. 14, 2013, now Pat. No. 8,950,510.

(60) Provisional application No. 61/618,872, filed on Apr. 2, 2012.

(51) Int. Cl.

| | |
|---|---|
| ***E21B 21/01*** | (2006.01) |
| ***E21B 21/06*** | (2006.01) |
| *E21B 21/00* | (2006.01) |

(52) U.S. Cl.

CPC ..... *E21B 21/01* (2013.01); *E21B 21/06* (2013.01); *E21B 21/066* (2013.01); *E21B 2021/007* (2013.01)

(58) Field of Classification Search

USPC ..... 175/88, 66, 206, 207, 217; 414/326; 198/663, 658, 493, 494; 336/186, 297, 336/300; 241/243; 134/108

See application file for complete search history.

(56) References Cited

U.S. PATENT DOCUMENTS

| | | | | |
|---|---|---|---|---|
| 1,462,997 | A * | 7/1923 | Anderson | E21D 9/10 299/56 |
| 2,048,569 | A | 7/1936 | Johnson | |
| 3,713,499 | A | 1/1973 | Arscott et al. | |
| 3,766,997 | A | 10/1973 | Heilhecker et al. | |
| 4,116,288 | A | 9/1978 | Love | |
| 4,168,035 | A | 9/1979 | Palm et al. | |
| 4,216,836 | A | 8/1980 | Rayborn | |
| 4,350,591 | A | 9/1982 | Lee | |
| 4,546,783 | A | 10/1985 | Lott | |

(Continued)

FOREIGN PATENT DOCUMENTS

EP 2547466 A2 1/2013

*Primary Examiner* — David Andrews
*Assistant Examiner* — Ronald Runyan
(74) *Attorney, Agent, or Firm* — The Webb Law Firm

(57) ABSTRACT

A drill cuttings conveyance system includes a collection tank that includes a screw conveyor and a chamber operable to accommodate drill cuttings, the screw conveyer extending along a longitudinal axis of the collection tank from a first end of the chamber to a second end of the chamber; a port disposed at the second end of the chamber of the collection tank, the port including a channel operable to direct the drill cuttings from the chamber of the collection tank; a pump including an inlet connected to the port and operable to receive drill cuttings from the port, an outlet, and a pumping mechanism operable to direct the drill cuttings through the outlet of the pump; and a drag chain conveyor in communication with the chamber of the collection tank via an auxiliary opening, the drag chain conveyor being operable to remove drill cuttings from the collection tank.

22 Claims, 16 Drawing Sheets

(56) References Cited

U.S. PATENT DOCUMENTS

| | | | | |
|---|---|---|---|---|
| 4,836,302 | A | 6/1989 | Heilhecker et al. | |
| 4,992,167 | A * | 2/1991 | Uchiyama | B01D 33/073 210/171 |
| 5,007,590 | A | 4/1991 | Taylor | |
| 5,109,933 | A | 5/1992 | Jackson | |
| 5,303,786 | A | 4/1994 | Prestridge et al. | |
| 5,454,957 | A | 10/1995 | Roff | |
| 5,639,035 | A | 6/1997 | Maugle et al. | |
| 6,110,367 | A | 8/2000 | Jensen et al. | |
| 6,276,824 | B1 | 8/2001 | De Jager | |
| 6,345,672 | B1 * | 2/2002 | Dietzen | B63B 27/20 175/206 |
| 6,602,181 | B2 | 8/2003 | Quintero et al. | |
| 6,936,092 | B2 | 8/2005 | Seyffert et al. | |
| 6,988,567 | B2 | 1/2006 | Burnett et al. | |
| 7,093,678 | B2 | 8/2006 | Risher et al. | |
| 7,195,084 | B2 | 3/2007 | Burnett et al. | |
| 7,404,903 | B2 | 7/2008 | Bozak et al. | |
| 7,493,969 | B2 | 2/2009 | Burnett et al. | |
| 7,575,072 | B2 | 8/2009 | Reddoch, Sr. | |
| 8,276,686 | B2 | 10/2012 | James | |
| 2006/0124361 | A1 | 6/2006 | Mundell et al. | |
| 2008/0107553 | A1 | 5/2008 | Mundell | |
| 2008/0135300 | A1 | 6/2008 | James | |
| 2008/0179090 | A1 | 7/2008 | Eia et al. | |
| 2008/0251428 | A1 | 10/2008 | Bailey | |
| 2009/0110565 | A1 | 4/2009 | Parrett et al. | |
| 2009/0227477 | A1 | 9/2009 | Burnett | |
| 2010/0047042 | A1 | 2/2010 | Templet, III | |
| 2010/0206383 | A1 * | 8/2010 | Getliff | E21B 21/01 137/1 |
| 2012/0073932 | A1 | 3/2012 | Burnett et al. | |
| 2012/0132504 | A1 | 5/2012 | Ardoin et al. | |

* cited by examiner

DRILL CUTTINGS CONVEYANCE SYSTEMS

CROSS REFERENCE TO RELATED APPLICATIONS

This application is a continuation-in-part of U.S. patent application Ser. No. 13/804,272, filed on Mar. 14, 2013, which claims the benefit of U.S. Provisional Patent Application No. 61/618,872, filed on Apr. 2, 2012, both of which are hereby incorporated by reference in their entireties.

BACKGROUND OF THE INVENTION

1. Field of the Invention

The present specification generally relates to drill cuttings conveyance systems and, more particularly, to systems and methods for conveying drill cuttings generated from oil and natural gas drilling operations.

2. Description of Related Art

Drill fluid generally includes one or more of hydrocarbons, water, salt, and other chemicals or substances and is widely used in oil and natural gas drilling operations. Drill fluid may provide subsurface pressure that aids in the prevention of underground fluids from entering the borehole, lubricates and cools the drill bit, and carries ground-up earth (which may be generally referred to herein as drill cuttings solids), in suspension, back to the surface so that it does not interfere with drilling operations. Typically, drill fluid is injected from the surface during the drilling process down through an annular channel within the drill string. The drill fluid then exits the drill string through nozzles or apertures in the drill bit where it thereafter returns to the surface in the area between the drill string and the walls of the borehole, carrying with it the drill cuttings solids so that they are removed from the borehole.

It may be desirable to reuse the drill fluid for further drilling operations after it has been recovered from the borehole. In order to do so, and in order to facilitate the disposal or recycling of the drill cuttings solids, the solids generally must be separated, or substantially separated, from the drill fluid. The drill cuttings containing drill fluids and solids, once it arrives at the surface, generally is passed over one or more shaker screens, also called rig shakers or shale shakers, that may vibrate to aid in the separation of the solids from the drill fluid. Generally, as drill cuttings pass over the shaker screens, the drill fluid passes through the screens, while the solids are caught by the screens and directed to a collection or storage area. Often, however, the use of shaker screens alone is insufficient to remove enough drill fluid from the solids to allow for the solids' disposal. Therefore, additional processing of the drill cuttings may be necessary to further remove drill fluid therefrom. Processing equipment often includes a hydrocyclone, centrifuge, or other similar equipment that generally is operable to process the drill cuttings for further removal of drill fluid.

A number of augers often are used to channel drill cuttings to various stages of conventional systems. Augers generally are rigid, fixed in length, and limited to the degree they can be positioned at an incline. Thus, augers tend to require a large amount of space to direct drill cuttings through or to a processing system. Further, augers may be susceptible to clogging with drill cuttings having a high viscosity and, conversely, can have difficulty in directing, particularly at an incline, drill cuttings having a low viscosity. For these reasons, and given the tendency of drill cuttings solids to settle, augers generally are not configured to passively receive (i.e., receive while not in operation) drill cuttings. As a result, augers tend to be in constant operation in an attempt to prevent such settling and blockages. Also, due to the large amount of surface area on the flights of an auger, drill cuttings constantly are wearing down or eroding the auger, rendering it to what may be a short operating life.

In addition, conventional systems and methods often rely on the use of heavy machinery, such as excavators, to handle or transport drill cuttings at various stages thereof. For instance, excavators commonly are used to transfer drill cuttings from a tank or pit to a processing system for removal of drill fluid. Once the drill cuttings have been processed and drill fluid has been substantially removed therefrom, the remaining solids of the drill cuttings often are directed into another auger, holding tank, or pit until they ultimately are transferred once again with the aid of an excavator to a vehicle or a transportable container for transport. The use of heavy machinery to transfer drill cuttings from one place to another generally is inefficient as such transfers often are inconsistent and fail to provide a continuous conveyance of drill cuttings to the processing equipment. In addition, having heavy equipment, such as excavators, on site is a costly expense to drill operators and may be hazardous to the working crew.

SUMMARY OF THE INVENTION

In accordance with one embodiment, a drill cuttings conveyance system includes a collection tank including a screw conveyor and a chamber operable to accommodate drill cuttings, the screw conveyor extending along a longitudinal axis of the collection tank from a first end of the chamber to a second end of the chamber; a port disposed at the second end of the chamber of the collection tank, the port including a channel operable to direct the drill cuttings from the chamber of the collection tank; a pump including an inlet connected to the port and operable to receive drill cuttings from the port, an outlet, and a pumping mechanism operable to direct the drill cuttings through the outlet of the pump; and a drag chain conveyor in communication with the chamber of the collection tank via an auxiliary opening, the drag chain conveyor being operable to remove drill cuttings from the collection tank.

The drag chain conveyor may be configured to be operated independently of the screw conveyor and the pump. The auxiliary opening may be disposed in the collection tank adjacent to the second end of the collection tank. The auxiliary opening may be disposed in a bottom of the collection tank and at least a portion of the drag chain conveyor extends under the collection tank such that drill cuttings can fall into the drag chain conveyor from the chamber of the collection tank through the auxiliary opening. The drag chain conveyor may be configured to direct drill cuttings from as bottom of the collection tank to a storage unit or vehicle.

The system may further include a processing platform including a base and one or more legs that elevate the base above as surface to a minimum height sufficient for removably positioning a storage unit in an area under the base; and processing equipment for processing the drill cuttings, the processing equipment being disposed on the base of the processing platform. The base of the processing platform is elevated with respect to the port and the pump is operable to direct the drill cuttings from the port to the processing equipment on the processing platform. The processing equipment on the platform is operable to direct solid portions of the drill cuttings removed from drill fluid portions of the drill cuttings to the area under the base where the storage unit may be removably positioned.

The screw conveyor may include a hammer disposed thereon and the collection tank may further include an anvil disposed within the chamber, the anvil is positioned in the chamber relative to the hammer such that the anvil and the hammer are cooperatively operable to grind drill cuttings accommodated by the chamber with rotation of the screw conveyor. The hammer and anvil are positioned within the chamber spaced away from the port such that the drill cuttings may be ground without being directed from the chamber to the port. The screw conveyor, the hammer, and the anvil may be configured to continuously grind the drill cuttings with none of the drill cuttings being directed from the chamber of the collection tank via the port. The screw conveyor may include a shaft and a flange helically extending along a length of the shaft and be operable to rotate bi-directionally relative to the first end and the second end of the chamber and to agitate the drill cuttings accommodated by the chamber with rotation. The system may further include at least one drive motor coupled to an end of the screw conveyor for imparting rotation to the screw conveyor.

In accordance with another embodiment, a method of processing drill cuttings includes providing a drill cuttings conveyance system that includes a collection tank including a screw conveyor and a chamber operable to accommodate drill cuttings, the screw conveyor extending along a longitudinal axis of the collection tank from a first end of the chamber to a second end of the chamber; a port disposed at the second end of the chamber of the collection tank, the port including a channel operable to direct the drill cuttings from the chamber of the collection tank; a pump including an inlet connected to the port and operable to receive drill cuttings from the port, an outlet, and a pumping mechanism operable to direct the drill cuttings through the outlet of the pump; processing equipment for processing the drill cuttings; and a drag chain conveyor in communication with the chamber of the collection tank via an auxiliary opening, the drag chain conveyor being operable to remove drill cuttings from the collection tank. The method further includes accumulating the drill cuttings in the chamber of the collection tank; agitating the drill cuttings in the chamber of the collection tank with the screw conveyor; directing the drill cuttings from the chamber of the collection tank to the pump via the port; operating the pump to direct the drill cuttings through the outlet of the pump to the processing equipment; processing the drill cuttings with the processing equipment to remove fluid from the drill cuttings; returning the processed drill cuttings to the collection tank to separate fully processed drill cuttings from drill cuttings containing unremoved fluid; and operating the drag chain conveyor to remove the fully processed drill cuttings from the chamber of the collection tank via the auxiliary opening.

The method may further include, after the processed drill cuttings have been returned to the collection tank, re-agitating the drill cuttings with the screw conveyor. The method may further include, after the processed drill cuttings have been returned to the collection tank, directing the drill cuttings containing unremoved fluid from the chamber of the collection tank to the pump via the port; operating the pump to direct the drill cuttings containing unremoved fluid through the outlet of the pump to the processing equipment; and re-processing the drill cuttings containing unremoved fluid with the processing equipment to remove additional fluid from the drill cuttings. The system may further include a processing platform including a base and one or more legs that elevate the base above a surface, wherein the base of the processing platform is elevated with respect to the port. The processing equipment is disposed on the base of the processing platform. The method may also further include removably positioning a storage unit on the surface underneath the base of the processing platform; and depositing by gravity feed the re-processed drill cuttings directly from the processing equipment into the storage unit.

The screw conveyor may include a hammer and the method may further include grinding the drill cuttings in the collection tank with an anvil of the collection tank and the hammer of the screw conveyor, the anvil is positioned in the collection tank relative to the hammer such that the anvil and the hammer cooperatively grind drill cuttings with rotation of the screw conveyor, and the hammer and the anvil are positioned away from the port such that the grinding step can be performed without the drill cuttings being directed to the pump via the port.

The auxiliary opening may be disposed in the collection tank adjacent to the second end of the collection tank. The auxiliary opening may be disposed in a bottom of the collection tank and at least a portion of the drag chain conveyor may extend under the collection to such that the fully processed drill cuttings can fall into the drag chain conveyor from the chamber of the collection tank through the auxiliary opening. The drag chain conveyor may be configured to direct drill cuttings from a bottom of the collection tank to a storage unit or vehicle. The drag chain conveyor may be configured to be operated independently of the screw conveyor and the pump.

These and other features and characteristics of the present invention, as well as the methods of operation and functions of the related elements of structures, and the combination of parts and economies of manufacture will become more apparent upon consideration of the following description and with reference to the accompanying drawings, all of which form a part of this specification, wherein like reference numerals designate corresponding parts in the various figures. It is to be expressly understood, however, that the drawings are for the purpose of illustration and description only, and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
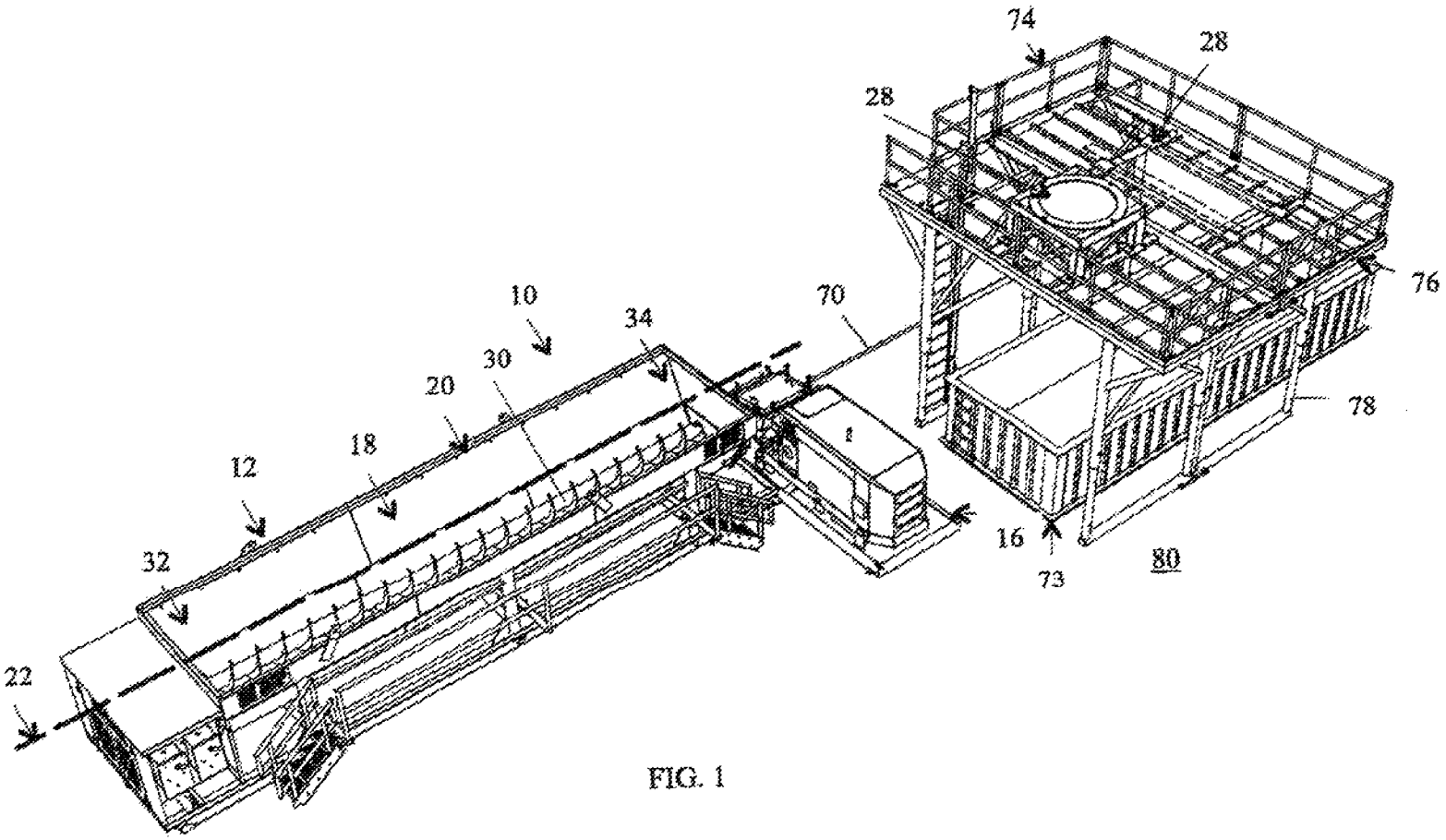
FIG. 1 is a perspective view of a drill cuttings conveyance system according to one or more embodiments.

For purposes of the description hereinafter, the terms "end", "upper", "lower" "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Embodiments described herein relate to drill cuttings conveyance systems and methods. As described herein, the conveyance systems and methods may be used to convey drill cuttings away from drill rig sites to processing equipment for removing drill fluid from the drill cuttings. Various embodiments of the drill cuttings conveyance systems, the operations thereof, and methods of conveying drill cuttings are described in more detail herein. As used herein, drill cuttings, unless described otherwise, refer generally to the drill fluid and the drill cuttings solids suspended therein that are returned to the surface from a borehole during oil and natural gas drilling operations. Also as used herein, processed drill cuttings, unless described otherwise, refer generally to drill cuttings that have been processed by processing equipment such that drill cuttings solids have been separated, or substantially separated, from the drill fluid in which the solids had been suspended.

Figure 2A:
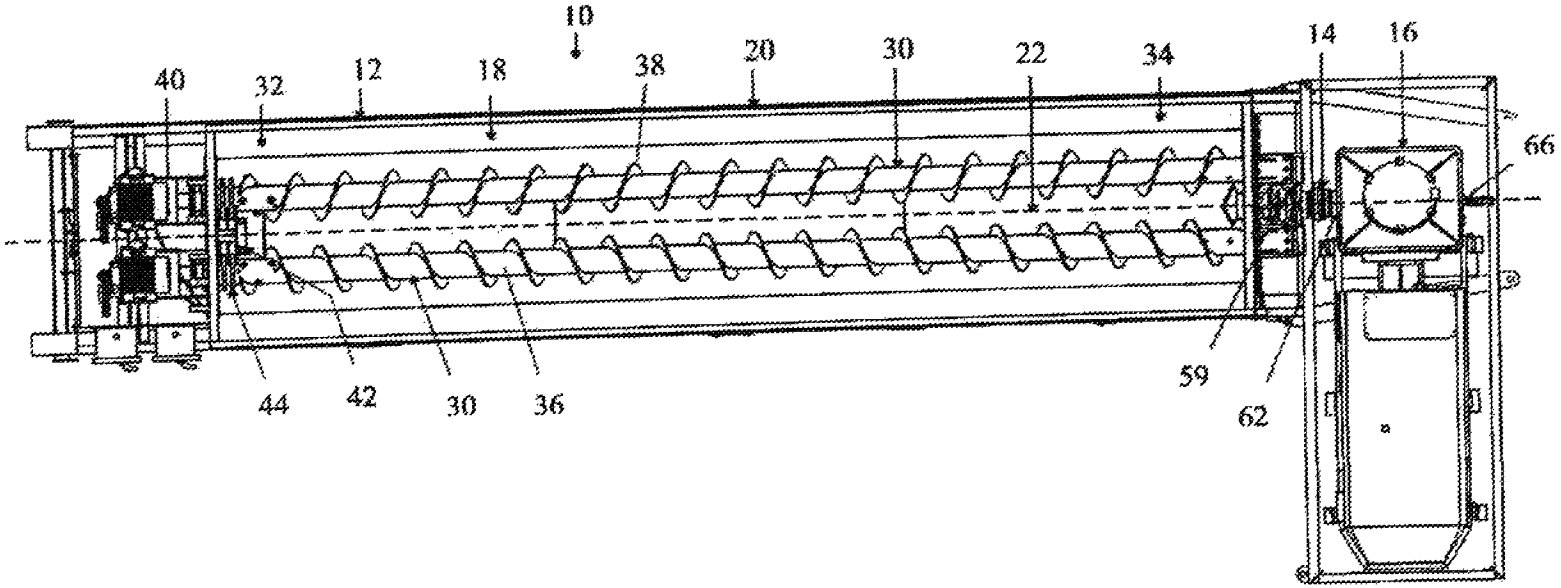
FIG. 2A is a top view of a drill cuttings conveyance system according to one or more embodiments.

Referring to FIG. 1, an embodiment of a drill cuttings conveyance system 10 includes components operable to convey drill cuttings without any handling, or with minimal handling, thereof by a working crew or heavy machinery once the drill cuttings are introduced into the system, potentially through a deposit of processed drill cuttings directly into a storage unit or transport vehicle by processing equipment. As shown in FIGS. 1 and 2A, the system 10 includes a collection tank 12, a port 14, and a pump 16. The collection tank 12 includes a chamber 18 operable to accommodate drill cuttings. The collection tank 12 may be any tank having such a chamber operable to receive drill cuttings directly from a drill rig or from shaker screens or other initial processing stage for removal of drill fluid therefrom. It is contemplated that the drill cuttings may be directed into the chamber 18 of the collection tank 12 via any suitable input device operable to direct the drill cuttings therein. Generally, the collection tank 12 receives the drill cuttings after they have been processed over the shaker screen(s) described above. The system 10 may be configured such that the drill cuttings may be conveyed directly into the collection tank 12 from the shaker screen(s) or other initial processing device or the drill rig. For example, as shown in the embodiments of FIGS. 1 and 2A, the collection tank 12 may include an open top end 20, or a top end partially or entirely covered with one or more grates, such that drill cuttings may fall or otherwise proceed directly into the chamber 18 of the collection tank 12 as they leave the shaker screen(s). In other embodiments, the system 10 may further include one or more of a screw conveyor, a sliding floor, a rod and scraper, a paddle, a belt conveyor, a paddle auger, a piston, a rotating drum, a sliding wall, and a bucket elevator that, individually or cooperatively in any combination thereof, are operable to direct the drill cuttings into and/or out of the collection tank 12. It is further contemplated that embodiments of the system 10 may additionally or alternatively include one or more devices or assemblies utilizing one or more of vibration, gravity, dilution, air injection, liquid dilation, and liquid agitation that are operable to direct drill, cuttings into and/or out of the collection tank 12.

Figure 3:
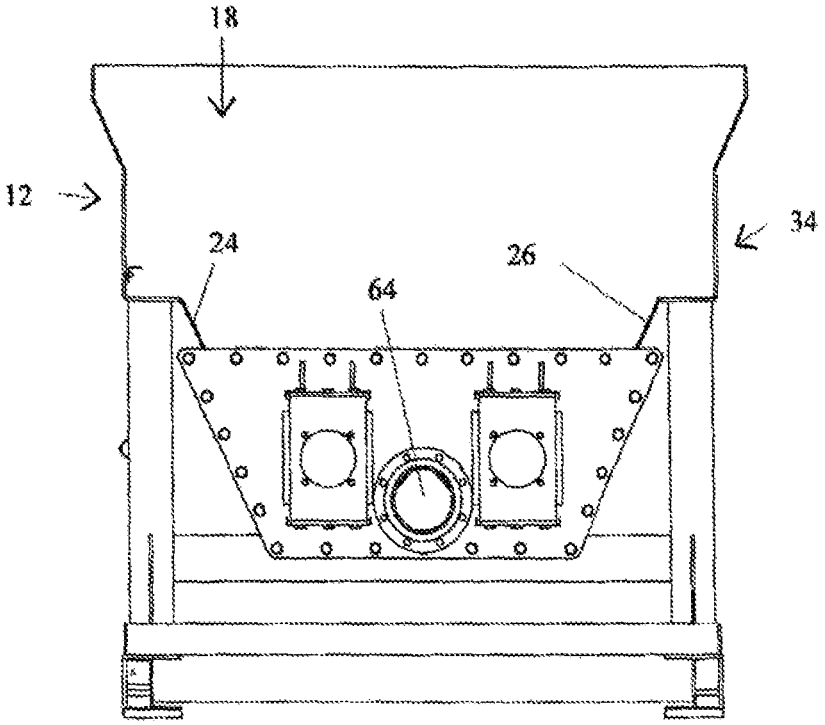
FIG. 3 is an end view of an embodiment of a collection tank for use with the drill cuttings conveyance system of FIG. 2A according to one or more embodiments.
Figure 4:
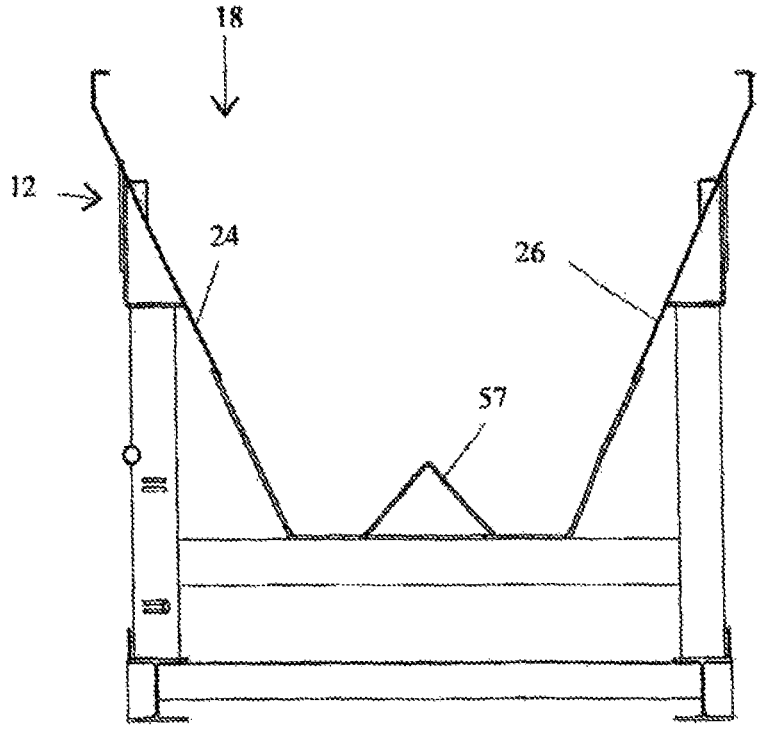
FIG. 4 is a cross-sectional view of the collection tank of FIG. 3 according to one or more embodiments.

The collection tank 12 and the chamber 18 thereof may be one of any variety of sizes and/or configurations sufficient to accommodate, and allow accumulation of, any desirable amount of drill cuttings. In one embodiment, shown in FIGS. 1 and 2A, the collection tank 12 includes a longitudinal axis 22. FIGS. 3 and 4 further illustrate the inwardly sloping, from top to bottom, walls 24, 26 of the embodiment of the collection an 12 shown in FIGS. 1 and 2A.

The collection tank 12 may passively receive and accommodate accumulating drill cuttings for significant durations, which may reduce the overall time necessary for system 10 operation and/or drill cuttings processing by processing equipment. For example, in one embodiment, the collection tank 12 is sized to receive and accommodate up to about 400 barrels of drill cuttings. Such an embodiment has the potential to eliminate the need for working crews to be on hand on a 24 hour basis. Further, such an embodiment offers reserve capacity for accommodating drill cuttings in the collection tank 12 during periods when the system 10 is not in operation, but drilling operations continue. More particularly, the operability of the collection tank 12 to passively receive and accommodate drill cuttings enables continued operations of a drill rig while the system 10 and/or drill cuttings processing equipment 28 are shut down.

The collection tank 12 also may be configured to allow for the adjustment of the viscosity of the drill cuttings accommodated by the chamber 18 of the collection tank 12 as it is believed that the viscosity of the drill cuttings may impact the removal of drill fluid from the drill cuttings by processing equipment 28. More particularly, it is believed that too high of a viscosity of the drill cuttings may hinder the ability of processing equipment 28 to which the conveyance system 10 may direct drill cuttings to remove drill fluid from the drill cuttings. Therefore, embodiments of the system 10 may further include a fluid input operable to direct fluid into the chamber 18 of the collection tank 12 to lower the viscosity of the drill cuttings held therein. Fluid inputted into the chamber 18 may be, for example, drill cuttings having a low viscosity, drill fluid, or water. Additionally, or alternatively, the system 10 may include a secondary pump or a drain provided in or to the collection lank 12 for pumping off or otherwise removing drill fluid from the drill cuttings accommodated by the chamber 18. For example, in one embodiment, the collection tank 12 includes a sump pump that is operable to pump fluid out of the tank 12. The sump pump and/or the collection tank 12 may include a screen to substantially allow only fluid drawn from the drill cuttings to enter the sump pump so that substantially only fluid is pumped out of the collection tank 12.

The collection tank 12 further includes one or more blenders or mixers, or other similar devices, operable to blend, mix, or agitate drill cuttings to provide a uniform, or substantially uniform, viscosity to the drill cuttings accommodated by the chamber 18. For instance, with passive receipt and accumulation of drill cuttings in the chamber 18 while the system 10 is not in operation, solids of the drill cuttings may settle from drill fluid to the bottom of the chamber 18. Such settling may result in formation of phases within the drill cuttings having differing viscosities. It is believed that drill cuttings having inconsistent viscosity levels that are provided to processing equipment may result in inconsistent and inefficient processing of the drill cuttings such that processed drill cuttings may have varying amounts of drill fluid remaining entrained with the solids. Processing equipment is believed to operate most effectively and efficiently when drill cuttings having a uniform, or substantially uniform, viscosity are provided to the equipment for processing. Blending, mixing, or agitating the drill cuttings in the chamber thus may provide a more uniform viscosity level to the drill cuttings and facilitate the processing thereof by processing equipment.

Figure 5A:
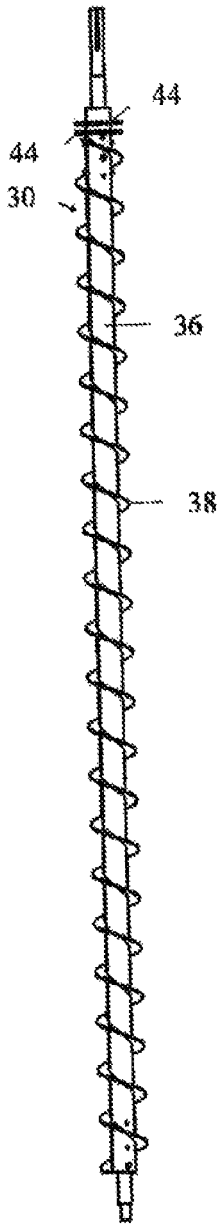
FIG. 5A is a side view of an embodiment of a screw conveyor for use with the drill cuttings conveyance system of FIG. 2A according to one or more embodiments.
Figure 5B:
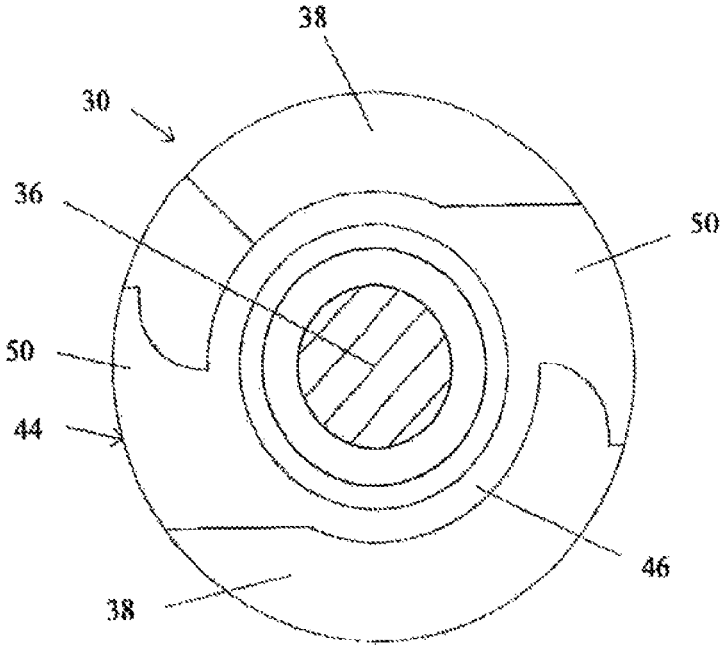
FIG. 5B is an end view of the screw conveyor of FIG. 5A according to one or more embodiments.

In the embodiment shown in FIG. 2A, the collection tank 12 includes one or more screw conveyors 30. The screw conveyors 30 extend along the longitudinal axis 22 of the collection tank 12 from a first end 32 of the chamber 18 to a second end 34 of the chamber 18. As shown in FIGS. 2A, 5A, and 5B, each screw conveyor 30 generally includes a shaft 36 and a flange 38 helically extending from a length of the shaft 36. The screw conveyors 30 generally are operable to rotate bi-directionally relative to the first end 32 of the chamber 18 and the second end 34 of the chamber 18, and to agitate drill cuttings accommodated by the chamber 18 with rotation. In one particular embodiment, shown in FIG. 2A, the collection tank 12 includes two bi-directionally rotatable screw conveyors 30 that extend, in parallel, along the longitudinal axis 22 of the collection tank 12. Two or more screw conveyors 30 arranged in this manner in the chamber 18 may, with rotation, facilitate the agitation of drill cuttings for a more uniform viscosity thereof and the conveyance of the drill cuttings to the pump 16, particularly those that have been passively received by and accumulated in the chamber 18 for some time without operation of the system 10 that, with settling, can compact, or substantially compact, at the bottom of the chamber 18. To impart rotation to the screw conveyors, the system 10 may further include a drive motor 40, as shown in FIG. 2A, coupled to an end of the screw conveyor 30.

To facilitate agitation of drill cuttings in the chamber 18 and the provision of a uniform, or substantially uniform, viscosity to the drill cuttings, the system 10 may further include an anvil 42. In such an embodiment, one or more of the screw conveyors 30 of the system 10 respectively may include one or more hammers 44 that may interact with the anvil 42 to grind or break down solids of the drill cuttings. The hammers 44 may extend from the shaft 36 of the screw conveyor 30 such that the hammers 44 rotate with rotation of the screw conveyor 30 from which they extend. The anvil 42 is positioned in the chamber 18 relative to the hammers 44 such that the anvil 42 and the hammers 44 are cooperatively operable to grind solids of the drill cuttings with rotation of the screw conveyors 30 and the hammers 44.

Figure 5C:
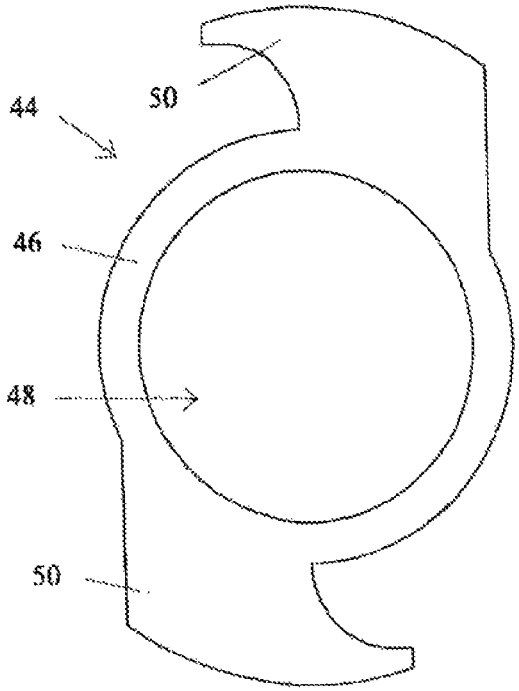
FIG. 5C is an isolated view of a hammer of the screw conveyor of FIGS. 5A and 5B for use with the drill cuttings conveyance system of FIG. 2A according to one or more embodiments.
Figure 7A:
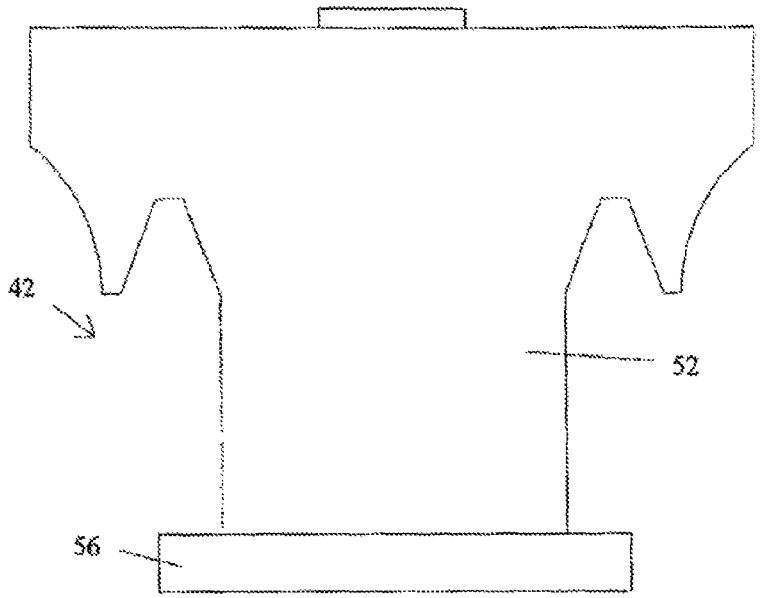
FIG. 7A is a side view of an embodiment of an anvil for use with the drill cuttings conveyance system of FIG. 2A according to one or more embodiments.
Figure 7B:
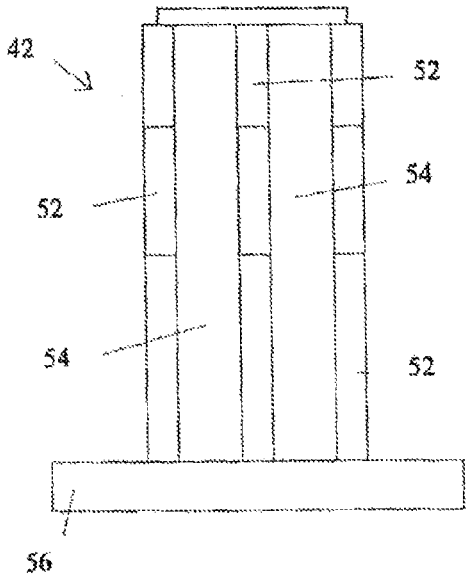
FIG. 7B is another side view of the anvil of FIG. 7A according to one or more embodiments.
Figure 7C:
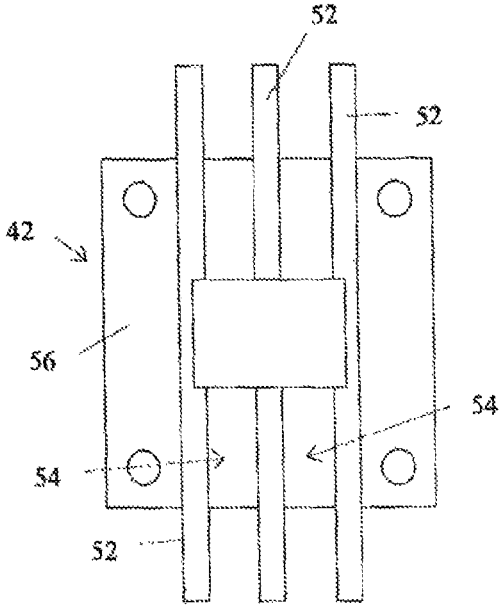
FIG. 7C is a top view of the anvil of FIGS. 7A and 7B according to one or more embodiments.

More particularly, for example, in one embodiment, shown in FIGS. 5A, 5B, and 5C, a hammer 44 includes a body 46 and a channel 48 therethrough that is sized to accommodate the shaft 36 of the screw conveyor 30 so that the hammer 44 may extend therefrom. The hammer 44 also includes one or more extensions 50 that project from the body 46. The extensions 50 may be spaced about a perimeter of the body 46 and are operable to capture drill cuttings solids for rotation with the hammer 44 toward the anvil 42. Additionally, in one embodiment shown in FIGS. 7A, 7B, and 7C, the anvil 42 includes two or more heads 52 and one or more channels 54 positioned between and separating the heads 52. The heads 52 are supported by a base 56 that may secure the anvil 42 directly to a wall of the collection tank 12 that defines the chamber 18. The anvil 42 generally is positioned in the chamber 18 relative to the hammer 44 such that, with rotation of the screw conveyor 30 and the hammer 44, the extensions 50 of the hammer 44 pass through the channels 54, and between the heads 52, of the anvil 42. In one embodiment, the heads 52 of the anvil 42 interact with the rotating extensions 50 of the hammers 44 at a tolerance of not more than about one-half of an inch with passage of the extensions 50 through the channels 54 of the anvil 42. Thereby, drill cuttings solids captured by the extensions 50 of the hammer 44 with rotation thereof may be ground or broken up by the interaction between the extensions 50 and the anvil heads 52. It is contemplated that the anvil 42 and the hammer 44 may be configured to interact at a tolerance other than about one-half of an inch, greater or lesser, sufficient to grind or break up drill cuttings solids as described herein. Further, as shown in FIG. 2A, the anvil 42 and the hammer 44 may be located at or near an end of the collection tank 12 nearest the drive motors 40 and farthest from the port 14 such that rotation of the screw conveyors 30 in a reverse direction of rotation directs the drill cuttings toward the anvil 42 and the hammer 44 for grinding and breaking down solids therein. It is contemplated that the anvil 42 may be removed from the chamber 18 when grinding or breaking down of drill cuttings solids is not needed or desirable.

Figure 2B:
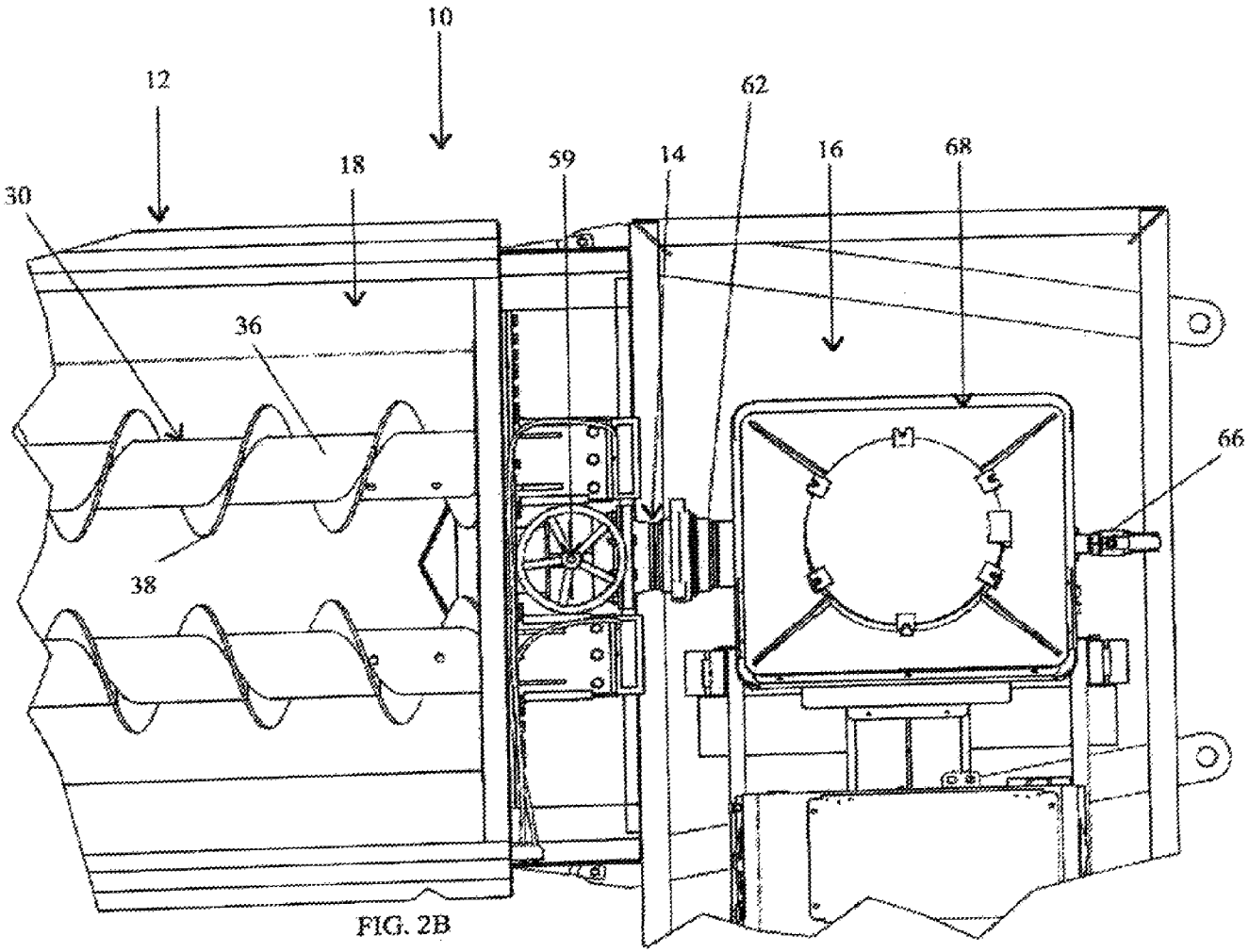
FIG. 2B is a magnified top view of a portion of the drill cuttings conveyance system of FIG. 2A according to one or more embodiments.

The collection tank 12 also may include one or more baffles 57 positioned in the chamber 18, as shown in FIG. 4. The baffles 57 are operable to facilitate agitation of the drill cuttings with rotation of the screw conveyors 30 by directing a flow of drill cuttings toward the screw conveyors 30. Additionally, or alternatively, as shown in FIG. 2B, the collection tank 12 may include a valve assembly 59 operable to open or close, partially or entirely, passage of drill cuttings from the chamber 18 to the port 14.

Figure 6A:
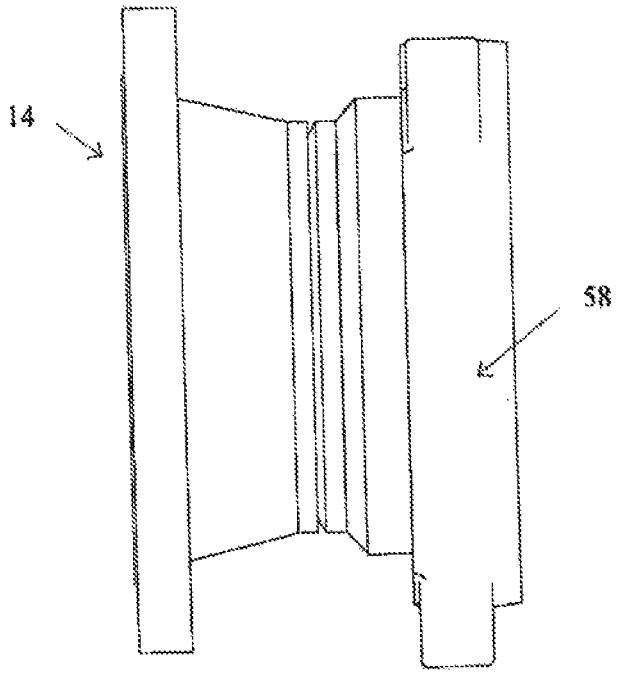
FIG. 6A is a side view of an embodiment of a port for use with the drill cuttings conveyance system of FIG. 2A according to one or more embodiments.
Figure 6B:
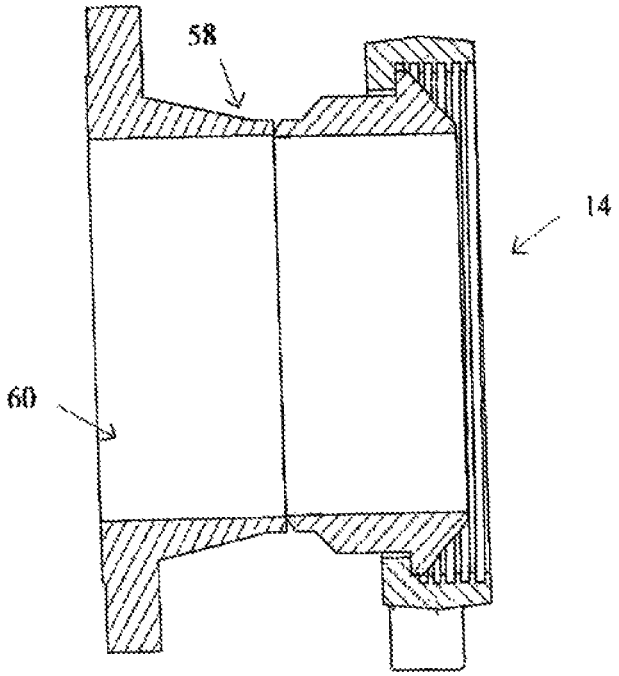
FIG. 6B is a cross-sectional view of the port of FIG. 6A according to one or more embodiments.

Following agitating and grinding, if either or any, of the drill cuttings in the chamber 18, drill cuttings may be permitted passage through the port 14 for conveyance by the system 10. More particularly, as shown in FIGS. 6A and 6B, the port 14 may include a body 58 and a channel 60 passing therethrough. The body 58 of the pert 14 is configured to couple to the collection tank 12 and an input 62 of the pump 16. When so coupled, as shown in FIG. 2A, the channel 60 of the port 14 provides a passage from, and directs, drill cuttings from the chamber 18, through an opening 64 in a well of the collection tank 12 (shown in FIG. 3), and into the pump input 62.

In one embodiment, the channel 60 of the port 14 includes a diameter of between about four inches and about sixteen inches; whereas, in another embodiment, the channel 60 includes a diameter of between about six inches and about ten inches; and whereas, in another embodiment, the channel 60 of the port 14 includes a diameter of about eight inches. It is believed and contemplated by the present invention that a combination of the size of the port channel 60 and a viscosity of the drill cuttings accommodated by the chamber 18 may determine whether the drill cuttings are permitted passage through the channel 60 of the port 14 and into the pump 16.

The pump 16, as described above, includes an inlet 62 operable to receive drill cuttings from the port 14. The pump 16 also includes an outlet 66 and a pumping mechanism 68 operable to direct the drill cuttings through the outlet 66. The pump 16 may be one of any variety of pumps operable or configured to perform in a manner as described herein. For example, in one embodiment, the pump 16 includes as hydraulically driven piston pump. The piston pump may have an infinitely variable rate adjustable to convey drill cuttings through the system 10 and to processing equipment 28, or elsewhere, at a desirable rate and may be stopped altogether, ceasing conveyance of drill cuttings by the system 10. For example, but not by way of limitation, the pump 16 may direct drill cuttings through its outlet 66 at a rate of between about zero barrels per hour and about 190 barrels per hour or, more particularly, at a rate of between about 80 barrels per hour and about 120 barrels per hour. The ability of the pump to provide a consistent, although variable, conveyance of drill cuttings to processing equipment facilitates consistent and continuous operation of the system 10 and the processing equipment on an as needed basis.

Figure 8A:
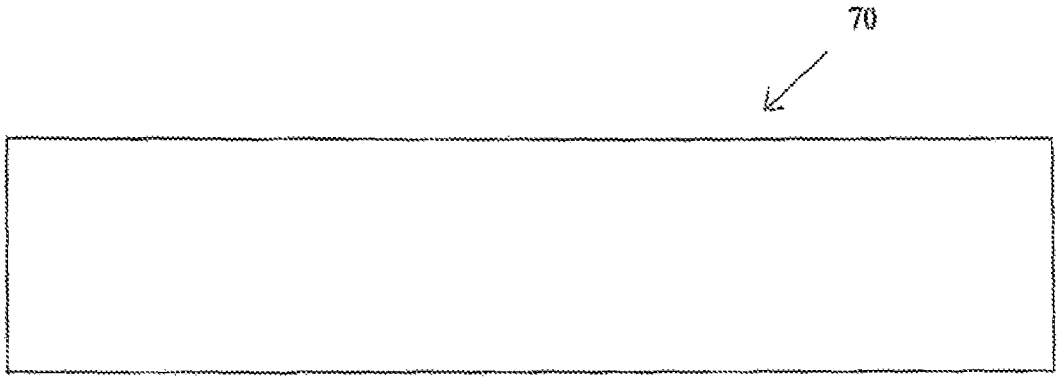
FIG. 8A is a side view of an embodiment of discharge piping for use with the drill cuttings conveyance system of FIG. 1 according to one or more embodiments.
Figure 8B:
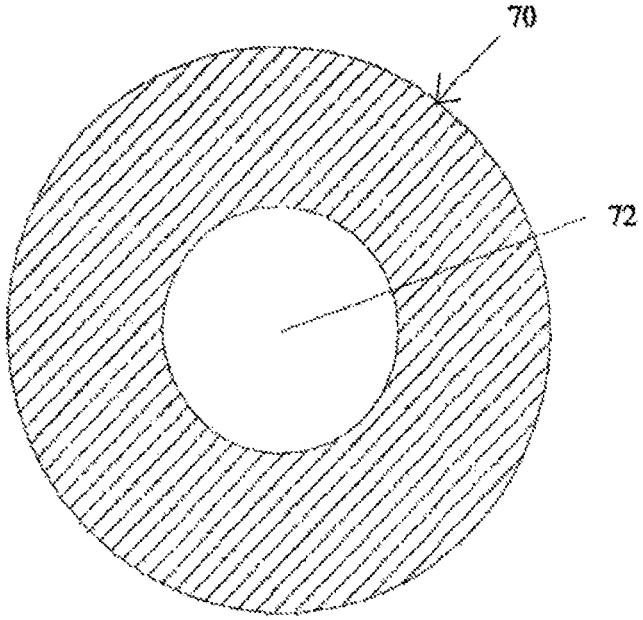
FIG. 8B is a cross-sectional view of the discharge piping of FIG. 8A according to one or more embodiments.
Figure 9:
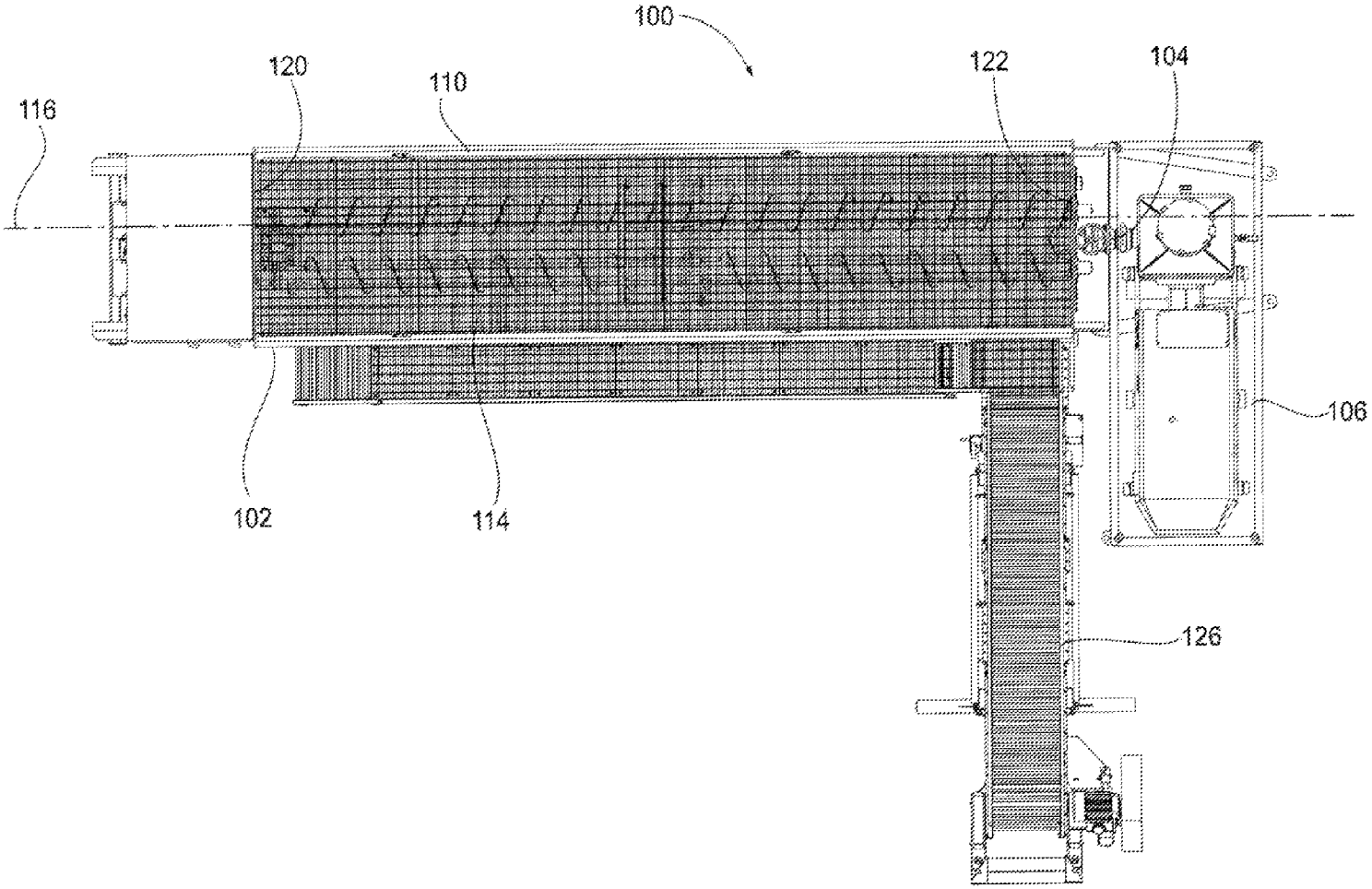
FIG. 9 is a top view drill cuttings conveyance system according to one or more embodiments.
Figure 10:
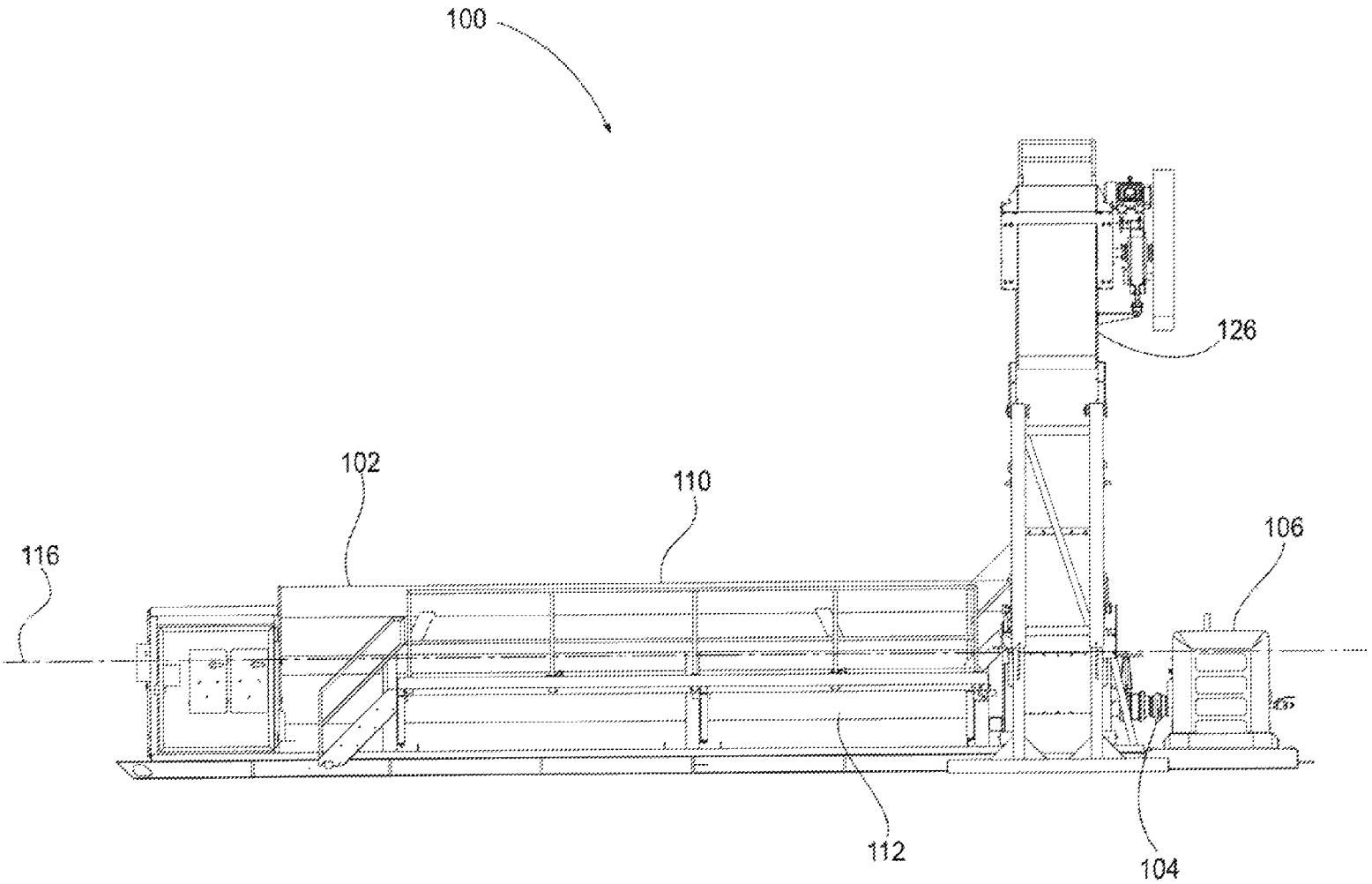
FIG. 10 is side view of the drill cuttings conveyance system of FIG. 9.
Figure 11:
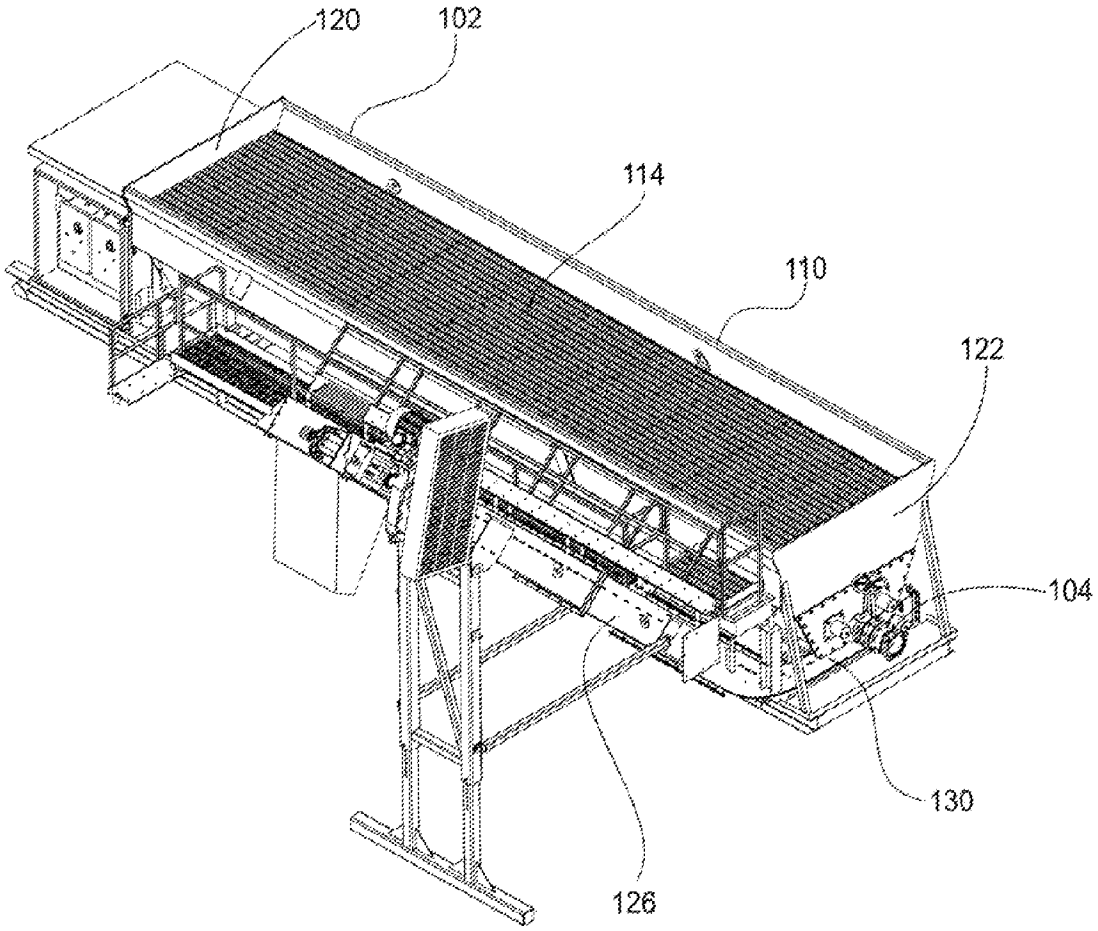
FIG. 11 is a perspective view of to portion of the drill cuttings conveyance system of FIG. 9.
Figure 12:
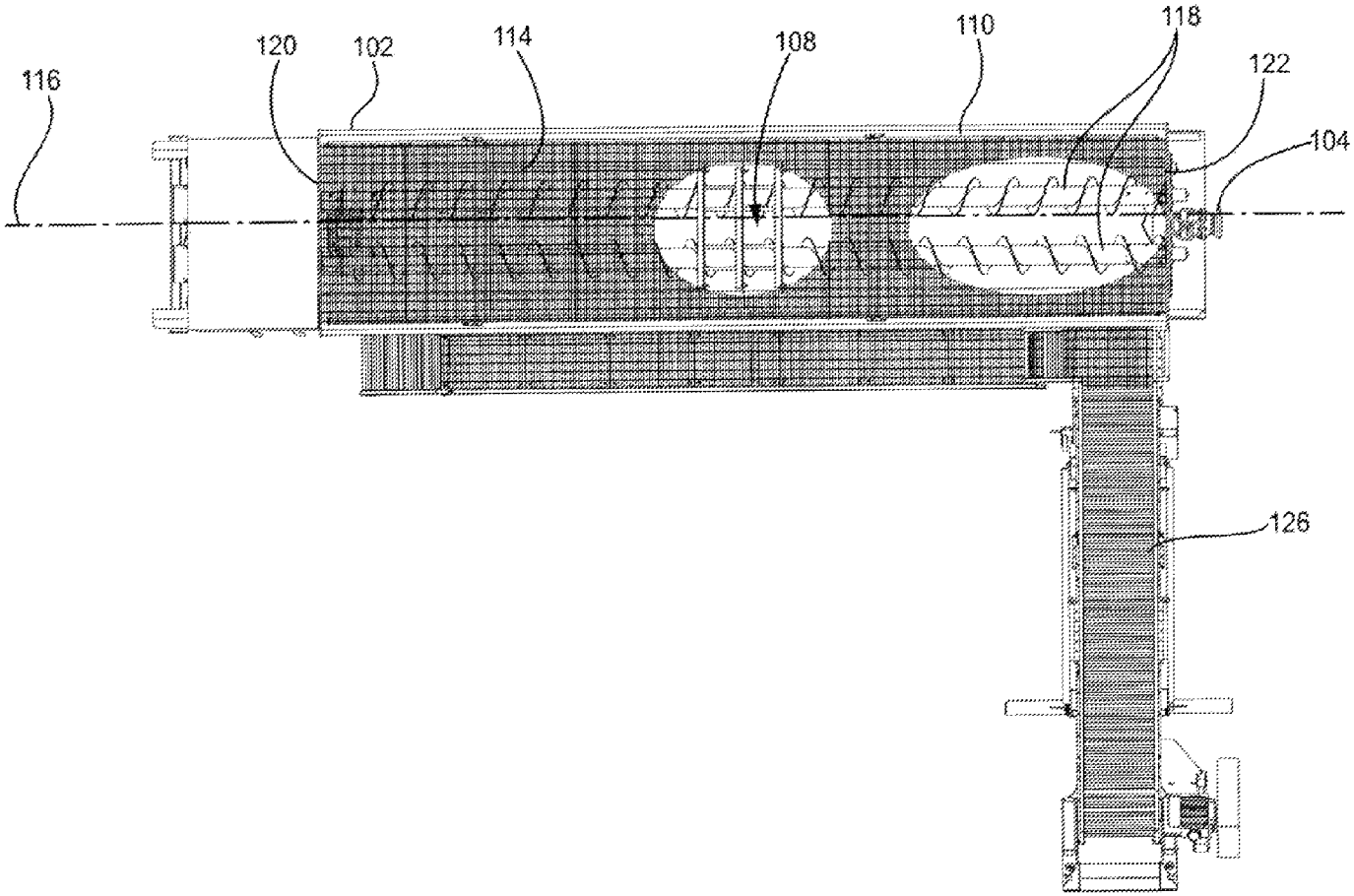
FIG. 12 is a top view of a portion of the drill cuttings conveyance system of FIG. 9.
Figure 13:
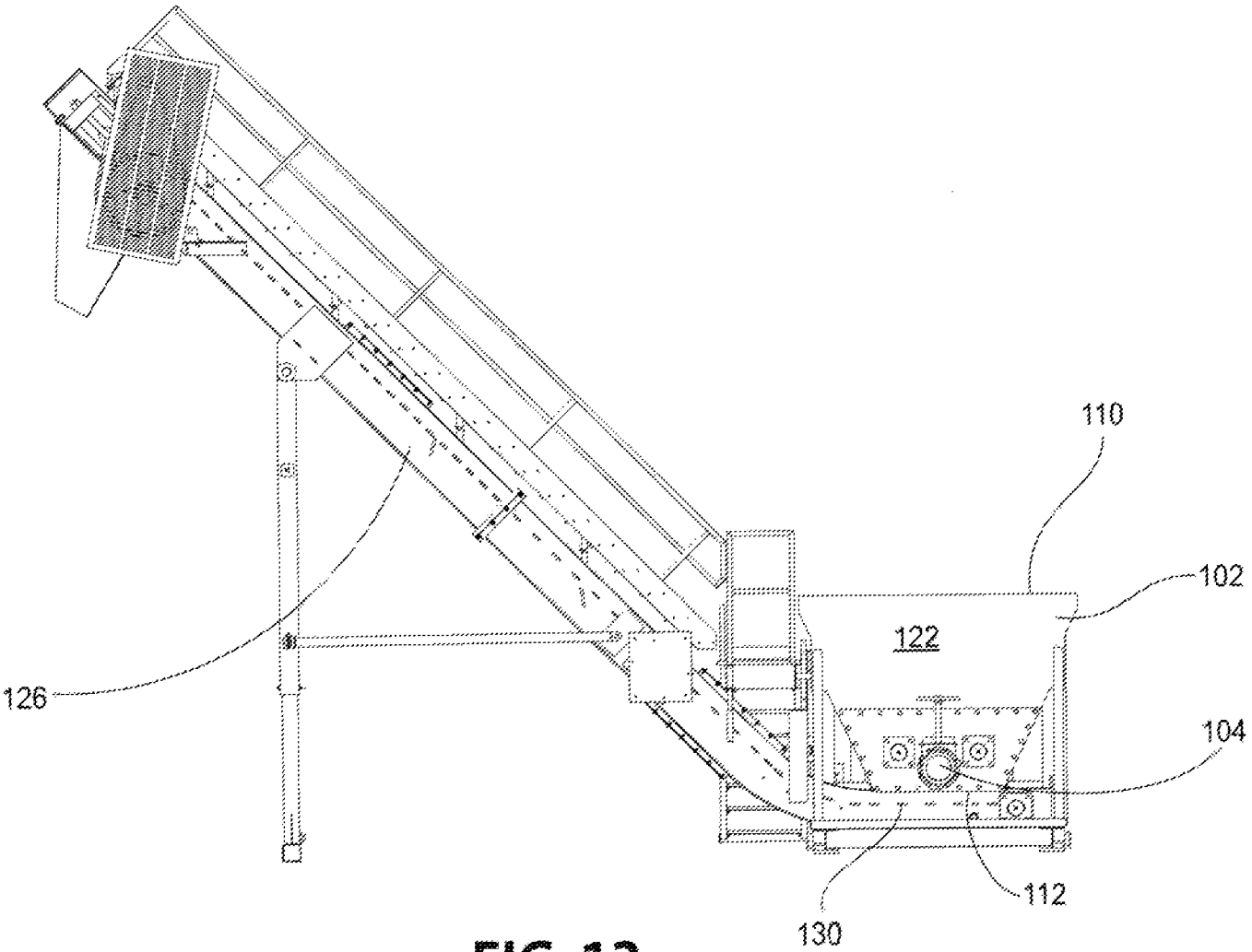
FIG. 13 is an end view of a portion of the drill cuttings conveyance system of FIG. 9.

As shown in FIGS. 1 and 8A, the system 10 may further include discharge piping 70 that may be configured to couple to the outlet 66 of the pump 16 and operable to direct drill cuttings from the pump 16 to processing equipment or elsewhere. The discharge piping 70 may include a channel 72 (shown in FIG. 8B) that may be sized to maintain, in coordination with the rate of the pump 16, a flow velocity of drill cuttings through the channel 72 of between about one foot per second and about nine feet per second, or, more particularly, at a flow velocity of between about three feet per second and about seven feet per second. For example, but not by way of limitation, the channel 72 of the discharge piping 70 may include a diameter of between about one inch and about six inches and, in one embodiment, includes a diameter of about two inches.

The discharge piping 70 may include piping, hoses, or other flexible or rigid conduit devices, or any combination thereof, that may be operable to direct drill cuttings to a variety of distances in arty number of directions to wherever processing equipment (or a storage unit 73) may be positioned, without the need for augers. For example, but not by way of limitation, the discharge piping 70, with the aid of the pump 16, may be operable to direct drill cuttings as far as about 500 feet laterally, or substantially laterally, and/or as high as about 100 feet vertically or substantially vertically. Such operability of the discharge piping 70 and the pump 16 enables the elevation of processing equipment above a surface to which drill cuttings may be conveyed by the system 10.

As shown in FIG. 1, the system 10 may further include a processing platform 74. The processing platform 74 may include a base 76 elevated by one or more legs 78 above a surface 80 at a minimum height and operable to support the processing equipment 28. The elevation of the base 76 above the surface 80 to the minimum height is at least sufficient for positioning of a storage unit 73 supported by a vehicle beneath, or at least partially beneath, the base 76 and processing equipment 28 supported thereon for immediate transport of the processed drill cuttings. Thereby, base-supported processing equipment, through the use of a chute or other similar device or configuration of the processing equipment, may deposit processed drill cuttings directly into the storage unit 73 positioned therebeneath, as shown in FIG. 1.

It is to be appreciated that a number of different types and combinations of processing equipment 28 may be supported on the processing platform 74 and in varying configurations depending on the particular processing needs of the driller and conditions at the drill site. For instance, the processing equipment may include varying combinations and configurations of one or more shaker screens, one or more hydrocyclones, one or more centrifuges, and/or one or more vertical cuttings dryers, and/or any other types or combinations of processing equipment known by those having ordinary skill in the art to be suitable for processing drill cuttings to remove and separate drilling fluid from the drill cuttings.

It is contemplated that the storage unit 73 may be part of or supported by a vehicle or may be bins suitable for transportation, thereby eliminating any need for use of heavy machinery, such as excavators, to handle the drill cuttings following processing. Further, using an embodiment of the system 10 described herein and elevating the processing equipment with the processing platform 74 can reduce the overall footprint needed to complete conveyance and processing of drill cuttings.

Further, in an embodiment in which the system 10 includes a processing platform 74, the system 10 may further include a slide rail system, or other similar system, operable to move the base 76 of the processing platform 74 along or about an elevated plane relative to the legs 78 of the platform 74. Thereby, lateral movement of the base 76 on the elevated plane may facilitate substantially equal distribution of drill cuttings into a storage unit 73 by the elevated processing equipment 28. In such an embodiment, it is contemplated that the discharge piping 70 may include a degree of flexibility sufficient to direct drill cuttings from the pump 16 to the elevated processing equipment while accommodating the mobility of the equipment on the elevated plane.

It is further contemplated that the system 10 may further include secondary discharge piping configured to couple to a discharge port of the processing equipment 2 and operable to direct drill fluid removed from the drill cuttings by the processing equipment 28 to a holding tank for drill fluid. There, the drill fluid may be directed for reintroduction into the borehole during drilling operations. For this reason, it is contemplated that an embodiment of the system 10 may also include one or more holding tanks operable to contain drill fluid and/or additional discharge piping operable to direct drill fluid from the holding tanks to a drill rig for drilling operations.

Additional embodiments relate generally to methods of conveying drill cuttings. In one such embodiment, a method includes providing a drill cuttings conveyance system including a collection tank, a port, a pump, discharge piping, and a processing platform, wherein the processing platform includes an elevated base operable to support processing equipment above a surface at a minimum height sufficient for the processing equipment to deposit drill cuttings directly into a storage unit; accumulating drill cuttings in the collection tank; agitating the drill cuttings in the collection tank with one or more rotatable screw conveyors of the collection tank; directing the drill cuttings from the collection tank to the pump with the port; operating the pump to direct the drill cuttings through an outlet of the pump to the discharge piping; directing the drill cuttings through the discharge piping to the processing equipment supplied by the processing platform; processing the drill cuttings with the processing equipment to remove fluid from the drill cuttings; and depositing the processed drill cuttings directly from the processing equipment into the storage unit.

In one embodiment, one or more of the screw conveyors includes a hammer and the method further includes grinding the drill cuttings in the collection tank with an anvil of the collection tank and the hammer of one or more of the screw conveyors, the anvil positioned in the collection tank relative to the hammer such that the anvil and the hammer cooperatively grind drill cuttings with rotation of the one or more screw conveyors. Further, in one embodiment, the drill cuttings are directed through the discharge piping to the processing equipment supported by the processing platform at a flow velocity of between about one foot per second and about nine feet per second.

With reference to FIGS. 9-16, a drill cuttings conveyance system 100 in accordance with one or more embodiments includes a collection tank 102 that includes at least one screw conveyor 118 and a chamber 108 operable to accommodate drill cuttings. The at least one screw conveyor 118 extends along a longitudinal axis 116 of the collection tank 102 from a first end 120 of the chamber 108 to a second end 122 of the chamber 108. The collection tank 102 also includes a top end 110, which may be covered with grates 114, and a bottom end 112 defining a bottom of the chamber 108. A port 104 is disposed at the second end 122 of the chamber 108 of the collection tank 102. The port 104 includes a channel operative to direct the drill cuttings from the chamber 108 of the collection tank 102. The system 100 further includes a pump 106 having an inlet connected to the port 104 and operable to receive drill cuttings from the port 104, an outlet, and a pumping mechanism operable to direct the drill cuttings through the outlet of the pump 106.

It is to be appreciated that the drill cuttings conveyance system 100 shown in FIGS. 9-16 is analogous in both structure and function to the drill cuttings conveyance system 10 discussed above with reference to FIGS. 1-8B, except with respect to certain features to be discussed in detail below. To that end, it is to be further appreciated that the system 100 can also include the processing platform 74 and processing equipment 28 discussed above; that the at least one screw conveyor 118 can include a hammer 44 disposed thereon for cooperating with an anvil 42 to grind drill cuttings within the chamber 108 and/or a shaft 36 and flange 38 helically extending along the shaft; and that the system 100 can include at least one drive motor 40 coupled to an end of the at least one screw conveyor 118.

Returning to FIGS. 9-16, the system 100 further includes a drag chain conveyor 126 that is disposed adjacent to the collection tank 102 and arranged to be in communication with the chamber 108 of the collection tank 102 via an auxiliary opening 128, shown in FIGS. 14 and 16. The drag chain conveyor 126 is of a construction that is known to those having ordinary skill in the art and is operable according to ordinary and well-known principles to remove drill cuttings from the chamber 108 of the collection tank 102. That is to say, the drag chain conveyor 126 is able to receive drill cuttings from the chamber 108 of the collection tank 102 and includes a drive assembly suitable to convey the drill cuttings via friction between the drive and the cuttings and/or via engagement of the cuttings with one or more paddle elements on the drive away from the chamber 108 of the collection tank 102 to a separate storage unit or vehicle (not shown) disposed adjacent to the collection tank 102.

Figure 14:
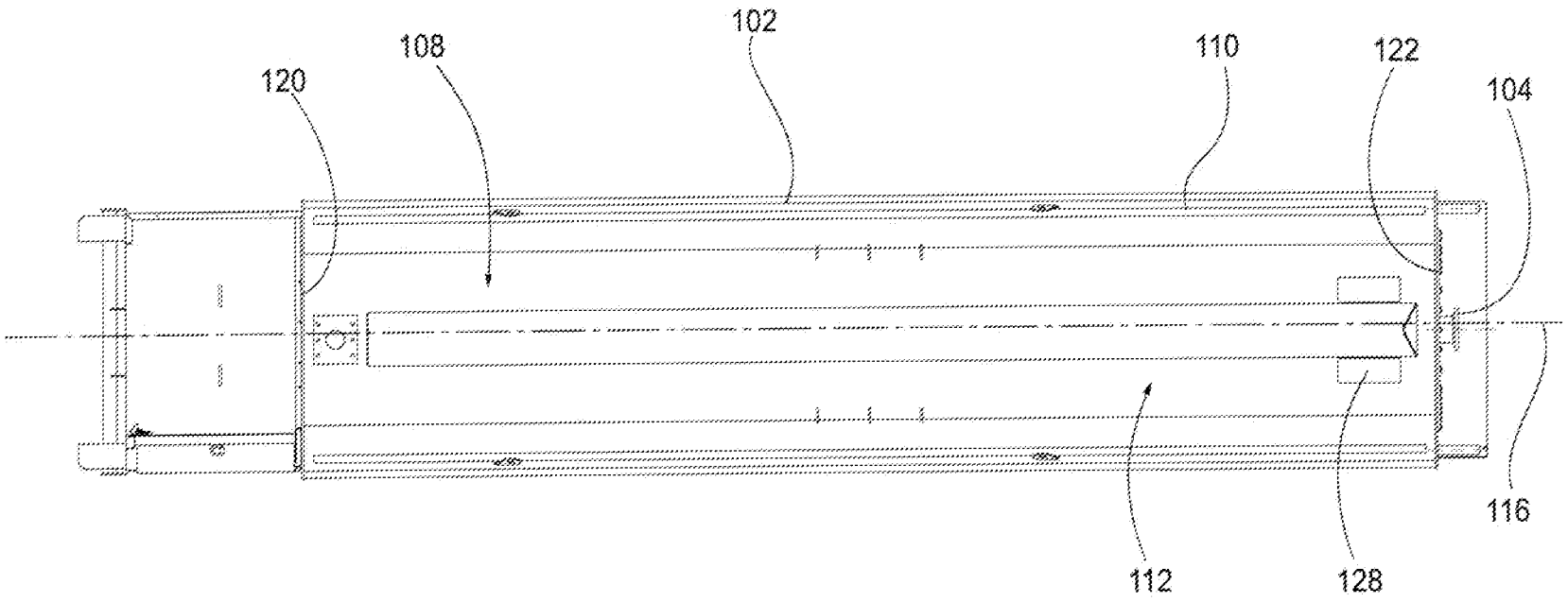
FIG. 14 is a top view of a collection tank of the drill cuttings conveyance system of FIG. 9.
Figure 15:
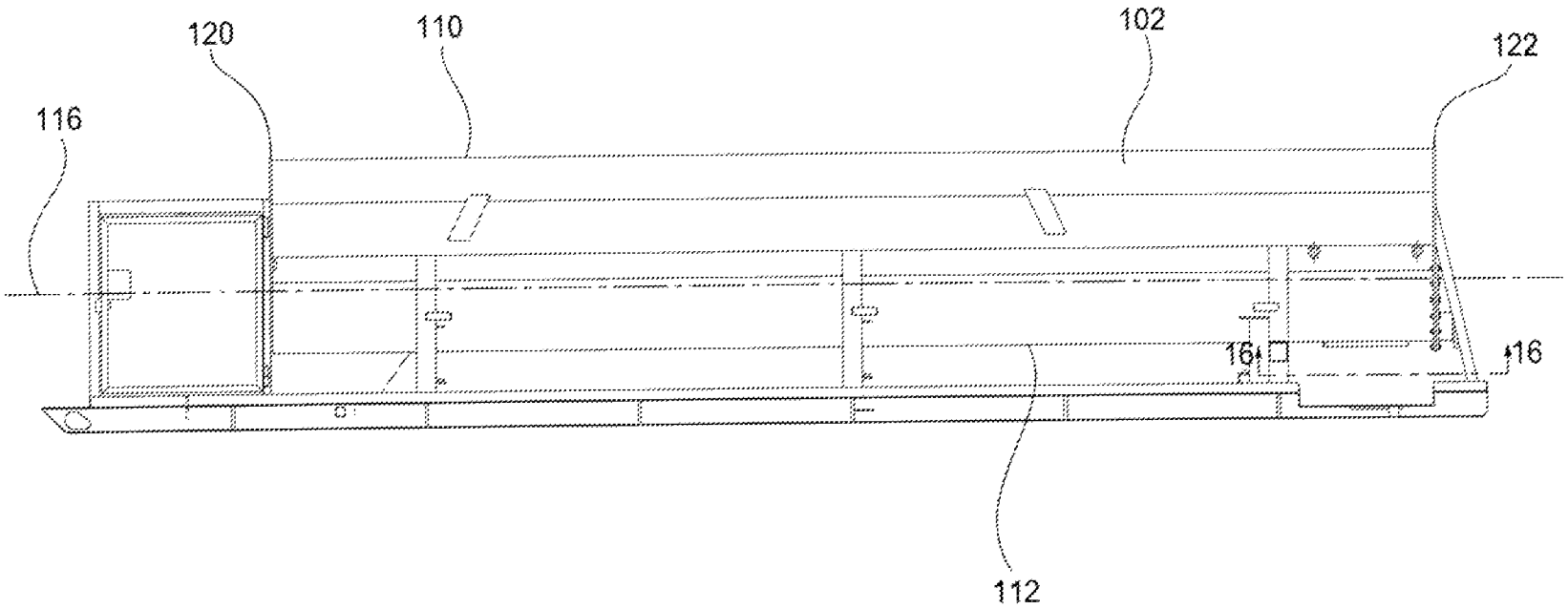
FIG. 15 is a side view of the collection tank of the drill cuttings conveyance system of FIG. 9.
Figure 16:
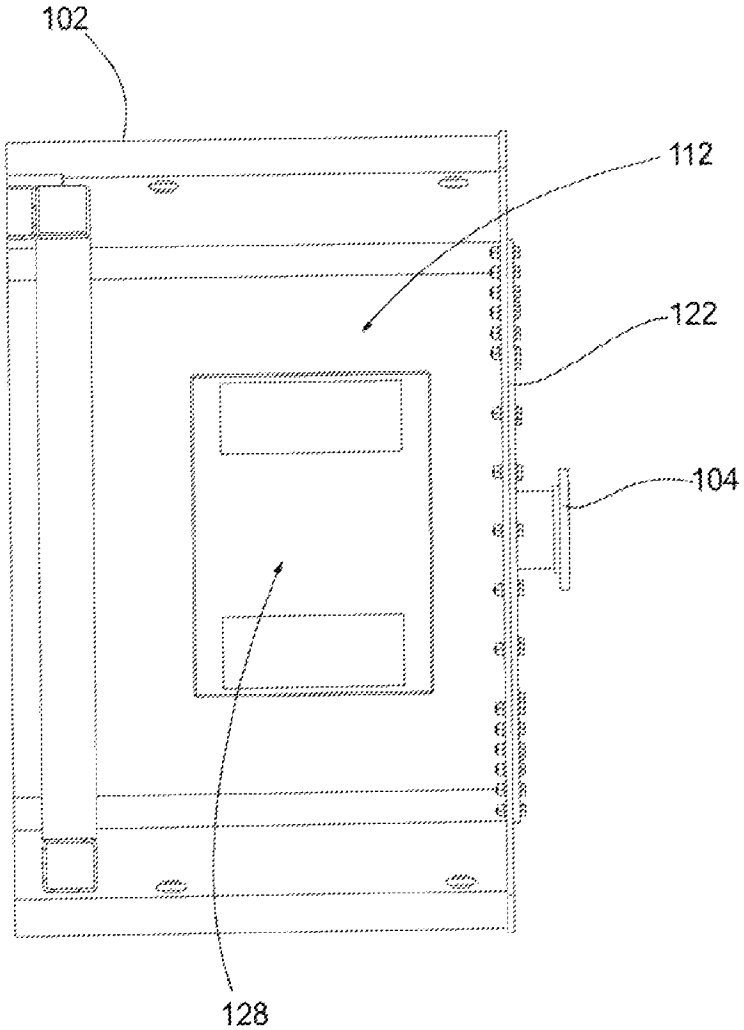
FIG. 16 is an enlarged bottom view of the collection tank taken along section 16-16 of FIG. 15.

In particular, as shown in FIGS. 14 and 16, the auxiliary opening 128 is disposed in the bottom 112 of the collection tank 102 adjacent to the second end 122 of the collection tank 102 and, as such, the port 104, such that drill cuttings directed towards the port 104 are also directed towards the auxiliary opening 128. As shown in FIGS. 9-13, the drag chain conveyor 126 is of an L-shaped configuration with a portion 130 of the drag chain conveyor 126 extending under the bottom 112 of the collection tank 102 such that drill cuttings can fall into the drag chain conveyor 126 from the chamber 108 of the collection tank 102 through the auxiliary opening 128. The drag chain conveyor 126 is therefore configured to direct drill cuttings from the bottom 112 of the collection tank 102 to the storage unit or vehicle. Additionally, the drag chain conveyor 126 may include its own power source and motor so as to be configured to be operated independently of the at least one screw conveyor 118 and the pump 106. It is to be appreciated, however, that the auxiliary opening 128 and drag chain conveyor 126 may be configured in any manner known to be suitable to those having ordinary skill in the art.

According to one embodiment, the drag chain conveyor 126 is provided to allow for re-processing of drill cuttings in the collection tank 102. Processed drill cuttings are likely to retain an appreciable amount of drill fluid that is lost when the processed drill cuttings are removed from the drill site for disposal despite thorough processing. On the other hand, processed drill cuttings contain too much solid material to be conveyed by a pump back to the processing equipment. When processed drill cuttings are returned to the collection tank 102 of the system 100, the drill cuttings will tend to settle such that the drill fluid will rise near to the top end 110 of the collection tank 102 while solid drill cuttings containing little to no drill fluid will settle towards the bottom 112 of the collection tank 102. The drag chain conveyor 126 may be operated to remove the solid drill cuttings from the bottom 112 of the collection tank 102 while the drill cuttings still containing drill fluid may be pumped back to the processing equipment 28 for re-processing in the manner discussed above.

With reference to FIGS. 1 and 9-16, a method is provided according to one or more embodiments of the invention that includes providing the drill cuttings conveyance system 100 described above; accumulating the drill cuttings in the chamber 108 of the collection tank 102; agitating the drill cuttings in the chamber 108 of the collection tank 102 with the at least one screw conveyor 118; directing the drill cuttings from the chamber 103 of the collection tank 102 to the pump 106 via the port 104; operating the pump 106 to direct the drill cuttings through the outlet of the pump 106 to the processing equipment 23; processing the drill cuttings with the processing equipment 28 to remove fluid from the drill cuttings; returning the processed drill cuttings to the collection tank 102 to separate fully processed drill cuttings from drill cuttings containing removed fluid; and operating the drag chain conveyor 126 to remove the fully processed drill cuttings from the chamber 108 of the collection tank 102 via the auxiliary opening 128. The method may further include, after the processed drill cuttings have been returned to the collection tank 102, re-agitating the drill cuttings with the at least one screw conveyor 118. The method may also or alternatively further include, after the processed drill cuttings have been returned to the collection tank 102, directing the drill cuttings containing unremoved fluid from the chamber 108 of the collection tank 102 to the pump 106 via the port 104; operating the pump 106 to direct the drill cuttings containing unremoved fluid through the outlet of the pump 106 to the processing equipment 28; and re-processing the drill cuttings containing unremoved fluid with the processing equipment 28 to remove additional fluid from the drill cuttings. Re-processed drill cuttings may be deposited by gravity feed directly from the processing equipment 28 into a storage unit 73 positioned below the processing equipment 28.

It is to be understood that the invention may assume various alternative variations and step sequences, except where expressly specified to the contrary. It is also to be understood that the specific devices and processes illustrated in the attached drawings, and described in the specification, are simply exemplary embodiments of the invention. Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope thereof. For example it is to be understood that the present invention contemplates that, to the extent possible, one or more features of any embodiment can be combined with one or more features of any other embodiment.

The invention claimed is:

1. A drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive drill cuttings from the port, an outlet, and a pumping mechanism operable to direct the drill cuttings through the outlet of the pump; and a drag chain conveyor in communication with the chamber of the collection tank via an auxiliary opening, the drag chain conveyor being operable to remove drill cuttings from the collection tank via the auxiliary opening, wherein the auxiliary opening is disposed in the collection tank adjacent to the second end of the collection tank.

2. The drill cuttings conveyance system according to claim 1, wherein the drag chain conveyor is configured to be operated independently of the screw conveyor and the pump.

3. The drill cuttings conveyance system according to claim 1, wherein the auxiliary opening is disposed in a bottom of the collection tank and at least a portion of the drag chain conveyor extends under the collection tank such that the drill cuttings can fall to the drag chain conveyor from the chamber of the collection tank through the auxiliary opening.

4. The drill cuttings conveyance system according to claim 1, wherein the drag chain conveyor is configured to direct drill cuttings from below the collection tank to a storage unit or vehicle.

5. The drill cuttings conveyance system according to claim 1, further comprising:

a processing platform comprising a base and one or more legs that elevate the base above a surface to a minimum height sufficient for removably positioning a storage unit in an area under the base; and processing equipment for processing the drill cuttings, the processing equipment being disposed on the base of the processing platform, wherein the base of the processing platform is elevated with respect to the port and the pump is operable to direct the drill cuttings from the port to the processing equipment on the processing platform, and wherein the processing equipment on the platform is operable to direct solid portions of the drill cuttings removed from drill fluid portions of the drill cuttings to the area under the base where the storage unit may be removably positioned.

6. The drill cuttings conveyance system according to claim 1, wherein the screw conveyor comprises a hammer disposed thereon and the collection tank further comprises an anvil disposed within the chamber, the anvil is positioned in the chamber relative to the hammer such that the anvil and the hammer are cooperatively operable to grind drill cuttings accommodated by the chamber with rotation of the screw conveyor, and wherein the hammer and anvil are positioned within the chamber spaced away from the port such that the drill cuttings may be ground without being directed from the chamber to the port.

7. The drill cuttings conveyance system according to claim 6, wherein the screw conveyor, the hammer, and the anvil are configured to continuously grind the drill cuttings with none of the drill cuttings being directed from the chamber of the collection tank via the port.

8. The drill cuttings conveyance system according to claim 1, wherein the screw conveyor comprises a shaft and a flange helically extending along a length of the shaft and is operable to rotate bi-directionally relative to the first end and the second end of the chamber and to agitate the drill cuttings accommodated by the chamber with rotation.

9. The drill cuttings conveyance system according to claim 1, further comprising at least one drive motor coupled to an end of the screw conveyor for imparting rotation to the screw conveyor.

10. A method of processing drill cuttings, comprising:

providing a drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive drill cuttings from the port, an outlet, and a pumping mechanism operable to direct the drill cuttings through the outlet of the pump;

processing equipment for processing the drill cuttings; and a drag chain conveyor in communication with the chamber of the collection tank via an auxiliary opening, the drag chain conveyor being operable to remove drill cuttings from the collection tank;

accumulating the drill cuttings in the chamber of the collection tank;

agitating the drill cuttings in the chamber of the collection tank with the screw conveyor;

directing the drill cuttings from the chamber of the collection tank to the pump via the port;

operating the pump to direct the drill cuttings through the outlet of the pump to the processing equipment;

processing the drill cuttings with the processing equipment to remove fluid from the drill cuttings;

returning the processed drill cuttings to the collection tank to separate fully processed drill cuttings from drill cuttings containing unremoved fluid; and operating the drag chain conveyor to remove the fully processed drill cuttings from the chamber of the collection tank via the auxiliary opening.

11. The method according to claim 10, further comprising:

after the processed drill cuttings have been returned to the collection tank, re-agitating the drill cuttings with the screw conveyor.

12. The method according to claim 10, further comprising:

after the processed drill cuttings have been returned to the collection tank, directing the drill cuttings containing unremoved fluid from the chamber of the collection tank to the pump via the port;

operating the pump to direct the drill cuttings containing unremoved fluid through the outlet of the pump to the processing equipment; and re-processing the drill cuttings containing unremoved fluid with the processing equipment to remove additional fluid from the drill cuttings.

13. The method according to claim 12, wherein the system further comprises a processing platform comprising a base and one or more legs that elevate the base above a surface, wherein the base of the processing platform is elevated with respect to the port, and wherein the processing equipment is disposed on the base of the processing platform.

14. The method according to claim 13, further comprising:

removably positioning a storage unit on the surface underneath the base of the processing platform; and depositing by gravity feed the re-processed drill cuttings directly from the processing equipment into the storage unit.

15. The method according to claim 10, wherein the screw conveyor comprises a hammer and the method further comprises grinding the drill cuttings in the collection tank with an anvil of the collection tank and the hammer of the screw conveyor, the anvil is positioned in the collection tank relative to the hammer such that the anvil and the hammer cooperatively grind drill cuttings with rotation of the screw conveyor, and the hammer and the anvil are positioned away from the port such that the grinding step can be performed without the drill cuttings being directed to the pump via the port.

16. The method according to claim 10, wherein the auxiliary opening is disposed in the collection tank adjacent to the second end of the collection tank.

17. The method according to claim 10, wherein the auxiliary opening is disposed in a bottom of the collection tank and at least a portion of the drag chain conveyor extends under the collection tank such that the fully processed drill cuttings can fall into the drag chain conveyor from the chamber of the collection tank through the auxiliary opening.

18. The method according to claim 10, wherein the drag chain conveyor is configured to direct drill cuttings from a bottom of the collection tank to a storage unit or vehicle.

19. The method according to claim 10, wherein the drag chain conveyor is configured to be operated independently of the screw conveyor and the pump.

20. A drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive drill cuttings from the port, an outlet, and a pumping mechanism operable to direct the drill cuttings through the outlet of the pump; and a drag chain conveyor in communication with the chamber of the collection tank via an auxiliary opening, the drag chain conveyor being operable to remove drill cuttings from the collection tank via the auxiliary opening, wherein the auxiliary opening is disposed in a bottom of the collection tank and at least a portion of the drag chain conveyor extends under the collection tank such that the drill cuttings can fall to the drag chain conveyor from the chamber of the collection tank through the auxiliary opening.

21. A drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive drill cuttings from the port, an outlet, and a pumping mechanism operable to direct the drill cuttings through the outlet of the pump;

a drag chain conveyor in communication with the chamber of the collection tank via an auxiliary opening, the drag chain conveyor being operable to remove drill cuttings from the collection tank via the auxiliary opening;

a processing platform comprising a base and one or more legs that elevate the base above a surface to a minimum height sufficient for removably positioning a storage unit in an area under the base; and processing equipment for processing the drill cuttings, the processing equipment being disposed on the base of the processing platform, wherein the base of the processing platform is elevated with respect to the port and the pump is operable to direct the drill cuttings from the port to the processing equipment on the processing platform, and wherein the processing equipment on the platform is operable to direct solid portions of the drill cuttings removed from drill fluid portions of the drill cuttings to the area under the base where the storage unit may be removably positioned.

22. A drill cuttings conveyance system, comprising:

a collection tank comprising a screw conveyor and a chamber operable to accommodate drill cuttings, the screw conveyor extending along a longitudinal axis of the collection tank from a first end of the chamber to a second end of the chamber;

a port disposed at the second end of the chamber of the collection tank, the port comprising a channel operable to direct the drill cuttings from the chamber of the collection tank;

a pump comprising an inlet connected to the port and operable to receive drill cuttings from the port, an outlet, and a pumping mechanism operable to direct the drill cuttings through the outlet of the pump; and a drag chain conveyor in communication with the chamber of the collection tank via an auxiliary opening, the drag chain conveyor being operable to remove drill cuttings from the collection tank via the auxiliary opening, wherein the screw conveyor comprises a hammer disposed thereon and the collection tank further comprises an anvil disposed within the chamber, the anvil is positioned in the chamber relative to the hammer such that the anvil and the hammer are cooperatively operable to grind drill cuttings accommodated by the chamber with rotation of the screw conveyor, and wherein the hammer and anvil are positioned within the chamber spaced away from the port such that the drill cuttings may be ground without being directed from the chamber to the port.

* * * * *

UNITED STATES PATENT AND TRADEMARK OFFICE

CERTIFICATE OF CORRECTION

PATENT NO. : 9,334,699 B2
APPLICATION NO. : 14/602736
DATED : May 10, 2016
INVENTOR(S) : Shawn Bender et al.

It is certified that error appears in the above-identified patent and that said Letters Patent is hereby corrected as shown below:

Title Page of the Patent, Column 2, Item (57) ABSTRACT, Line 3, delete "conveyer" and insert -- conveyor --

Signed and Sealed this
Twenty-third Day of August, 2016

Michelle K. Lee

Michelle K. Lee
*Director of the United States Patent and Trademark Office*